United States Patent [19]

Kral

[11] 4,203,602

[45] May 20, 1980

[54] BALL BUMPER

[75] Inventor: Fred G. Kral, Lake Villa, Ill.

[73] Assignee: Mattel, Inc., Hawthorne, Calif.

[21] Appl. No.: 820,908

[22] Filed: Aug. 1, 1977

[51] Int. Cl.[2] ..... A63D 3/02

[52] U.S. Cl. ..... 273/121 A; 273/129 R

[58] Field of Search ..... 273/119 R, 119 A, 121 R, 273/121 A, 121 D, 122 R, 122 A, 122 D, 123 R, 123 A, 124 R, 124 A, 125 R, 125 A, 127 R, 127 B, 129 R, 120 A; 200/61.11

[56] References Cited

U.S. PATENT DOCUMENTS

| | | | |
|---|---|---|---|
| 2,109,678 | 3/1938 | Nelson | 200/52 |
| 2,184,866 | 12/1939 | Radtke | 273/119 A |
| 2,191,209 | 2/1940 | Hooker | 273/121 A |
| 2,209,589 | 7/1940 | Williams et al. | 200/61.11 |
| 2,219,898 | 10/1940 | Hooker | 273/129 |
| 2,248,596 | 7/1941 | Wilsey | 273/119 A |
| 2,275,005 | 3/1942 | Bevington | 273/118 A |
| 2,501,021 | 3/1950 | Benak | 273/118 A |
| 2,727,743 | 12/1955 | Von Stoeser | 273/118 A |
| 3,348,844 | 10/1967 | Lemelson | 273/121 A |
| 3,784,203 | 1/1974 | Nathanson | 273/128 R |

FOREIGN PATENT DOCUMENTS

| | | | |
|---|---|---|---|
| 1382662 | 11/1964 | France | 273/119 A |
| 585246 | 11/1958 | Italy | 273/119 A |

*Primary Examiner*—Richard C. Pinkham
*Assistant Examiner*—T. Brown
*Attorney, Agent, or Firm*—John G. Mesaros; Max E. Shirk; Ronald M. Goldman

[57] ABSTRACT

A ball bumper for a pinball machine or the like having an inclined playing surface over which a metal ball travels for scoring purposes, the ball bumper including a plurality of post members secured to the playing surface, the post members having suspended therebetween an at least partially conductive resilient bumper member yieldable under impact by a rolling ball. Disposed rearwardly of the bumper member and in proximity to the bumper member is a solenoid actuated kicker arm. On the playing surface in proximity to the resilient bumper member is a conductive strip, the strip and the bumper member being connected to an electrical circuit which is completed by contact of the metal ball with the strip and bumper member to actuate the solenoid to drive the bumper member outwardly to thereby redirect the ball. The resilient bumper member may take the form of a rubber ring made of conductive rubber.

8 Claims, 10 Drawing Figures

FIG. 1
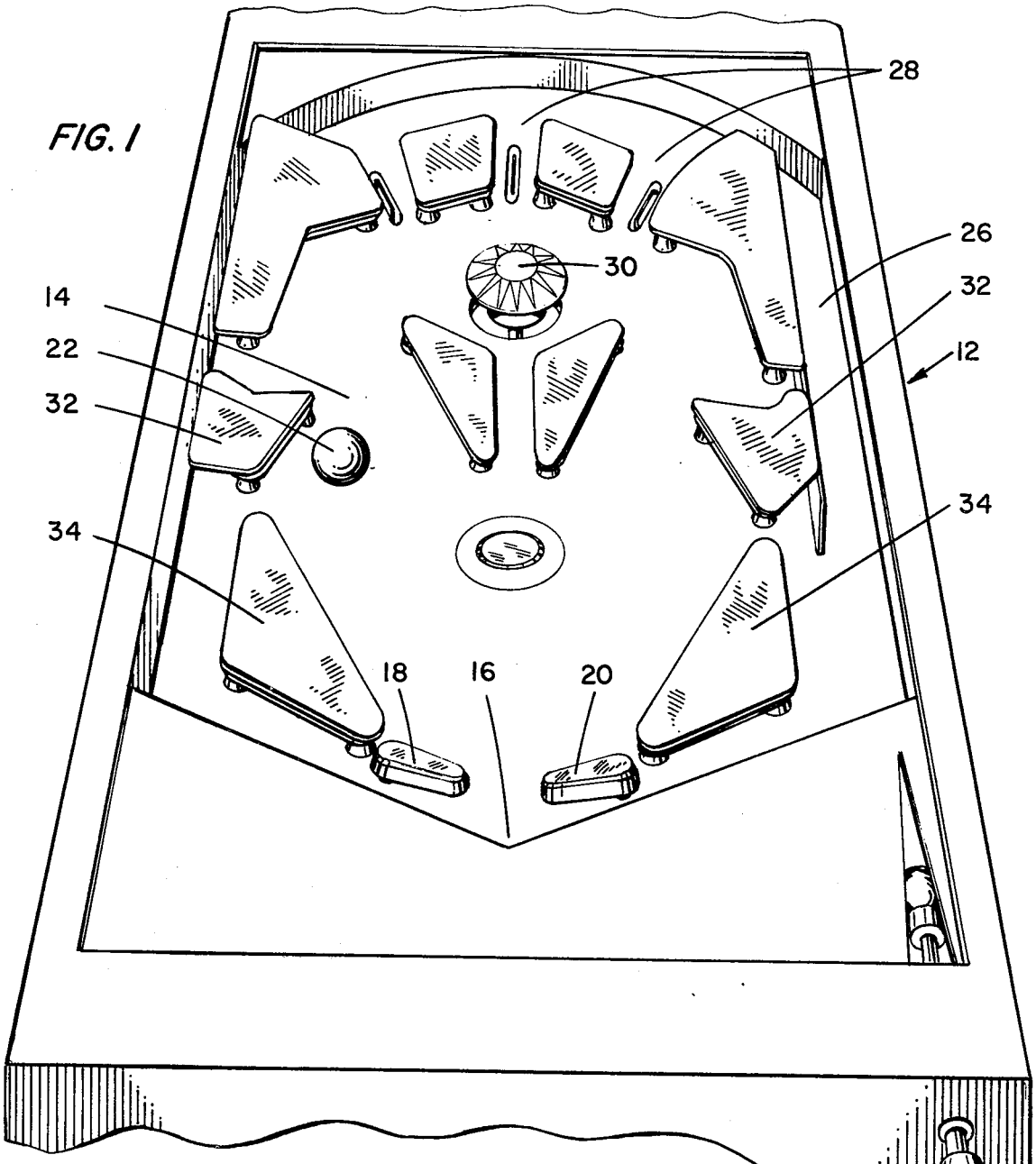
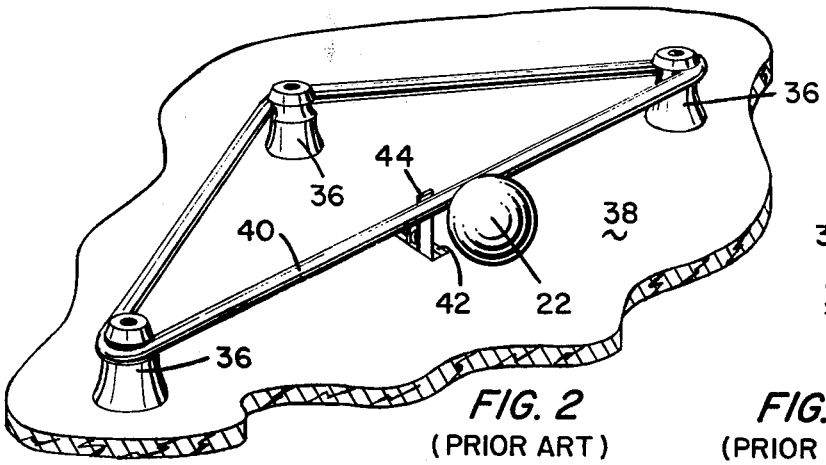
FIG. 2
(PRIOR ART)
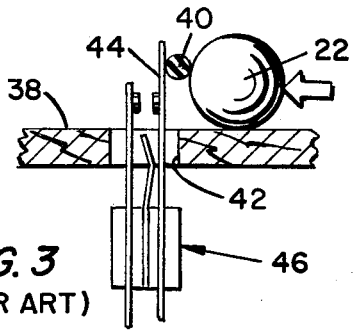
FIG. 3
(PRIOR ART)

BALL BUMPER

BACKGROUND OF THE INVENTION

The background of the invention will be discussed in two parts:

1. Field of the Invention

This invention relates to ball bumpers for a ball rolling game and more particularly to a ball bumper for a pinball machine.

2. Description of the Prior Art

In pinball machine playing apparatus, a metal ball traverses an inclined playing surface, the metal ball being projected from a start position by a manually-operated spring-biased shooter to travel up an incline guideway to return down the playing surface under the force of gravity. Various switches, "post" bumpers, and "slingshot" bumpers are positioned about the playing surface to be impacted along the path of travel of the ball. Adjacent the bottom of the incline, and sometimes at intermediate points, are flipper mechanisms which are solenoid actuated and operator controlled to redirect the ball up the inclined playing surface upon command and under control of the operator. Other guiding elements and barriers are often interposed on the playing surface to increase the amount of skill required for the game. In conjunction with the various switches and obstacles, electrical circuitry is employed to convert the impact of the playing ball at various points into scoring, which is normally visually displayed on the face of the vertical compartment at the end of the pinball machine opposite the operator's position.

The slingshot mechanism hereinabove referred to is a ball bumper assembly which may comprise two, three or more posts extending generally perpendicular to the playing surface and about which is suspended a resilient elastic band disposed generally parallel to the playing surface, the band being adapted for contact by the approximate mid-point of the playing ball. In some such slingshot assemblies, a leaf switch is disposed immediately behind and spaced from the elastic band, the switch being contacted by the band upon impact of the ball to actuate other devices such as scoring means, with the redirection of the ball being effected by the resilient force of the elastic band. In other slingshot assemblies, a solenoid actuated "kicker" arm is disposed immediately behind and spaced from the elastic band with a pair of leaf switches disposed on either side thereof for contact by the elastic band upon impact of a rolling ball, the closing of the leaf switches energizing the solenoid to actuate the kicker arm against the elastic band to thereby redirect the rolling ball with additional impetus.

Some ball bumpers which have been previously devised, of the "post" type are shown in U.S. Pat. No. 2,209,589 which is a combination ball switch and bumper wherein spaced parallel contact plates encircle the posts with the weight of the metal ball urging the flexible top plate into contact with the lower plate to thereby complete an electrical circuit; 2,727,743 which is a post bumper with a movable skirt; and 2,501,021 in which the post has a conical surface encircled by a coil spring member which is urged outwardly upon downward axial movement of the conical surface to reproject the ball.

Many of such posts employ switch means in contact therewith to effect scoring or actuation of other electrical parts.

In some pinball machine type devices, all or a portion of the playing field has been rendered conductive to utilize the metal ball as part of an electrical circuit which is completed when the metal ball impacts with another conductive member to thereby complete an electrical circuit. In U.S. Pat. No. 2,191,209; 2,219,898; and 2,184,866 the playing field is a metal plate with various posts, projections or bumpers being engaged by the ball to complete electrical circuits for actuating solenoids or scoring apparatus. In U.S. Pat. No. 3,348,844 the game effects scoring by means of the ball bridging the gaps of electrically conductive strips embedded in the playing surface.

In many of the above-referenced patents, where the devices employ the ball as a means of bridging electrodes or conductive members to actuate a solenoid, the impact of the ball in closing the circuit is momentary in form and often times, the solenoid traverses only a small amount of movement due to the momentary actuation, thereby effectively diminishing the impact or thrust of the solenoid in redirecting the ball.

Accordingly, it is an object of this invention to provide a new and improved ball bumper assembly.

It is another object of this invention to provide a new and improved slingshot ball bumper assembly.

It is still another object of this invention to provide a new and improved ball bumper assembly having electrical circuit means for actuating a solenoid to pivot a kicker arm to redirect the ball.

SUMMARY OF THE INVENTION

The foregoing and other objects of the invention are accomplished by providing a ball bumper assembly including a plurality of posts secured to the playing surface, the post members having suspended therebetween or thereabout an at least partially conductive resilient bumper member yieldable under impact by a rolling metal ball. Disposed rearwardly of the bumper member in proximity thereto is a solenoid actuated kicker arm. The playing surface, in proximity to the resilient bumper member is provided with a conductive strip, the strip and the bumper member being connected to an electrical circuit which is completed by contact of the metal ball with the strip and bumper member. Contact of the ball to complete the circuit triggers first electrical means which in turn energize power circuit means to energize the solenoid through a complete cycle regardless of the momentary contact of the ball in completing the circuit. The resilient bumper member may take the form of a rubber ring made of conductive rubber spaced generally parallel to the playing surface for impact by the approximate mid-point of the ball. Alternatively, the resilient bumper member may take the form of a coil spring which may be suitably dampened by insertion therein of a rubber or plastic dampening member. As another alternative, the resilient bumper member may be in the form of an elastic band having a length of wire secured to the outer surface thereof in proximity to the conductive strip with the wire having terminal means for connection to the electrical circuit.

Other objects, features and advantages of the invention will become apparent from a reading of the specification when taken in conjunction with the drawings in which like referenced numerals refer to like elements in the several views.

BRIEF DESCRIPTION OF THE DRAWINGS

FIG. 1 is a perspective view of the top side of a pinball machine incorporating a bumper assembly according to the invention;

FIG. 2 is a perspective view of a prior art slingshot ball bumper assembly;

FIG. 3 is a cross-sectional view as viewed generally along line 3—3 of the prior art slingshot mechanism of FIG. 2;

DESCRIPTION OF THE PREFERRED EMBODIMENT

Figure 4:
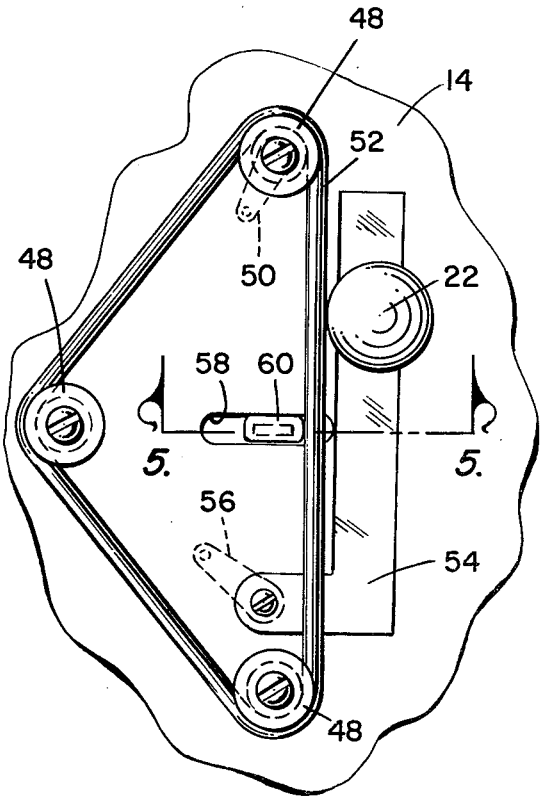
FIG. 4 is a top plan view of a slingshot ball bumper mechanism in accordance with the invention.

Referring now to the drawings and particularly to FIG. 1, there is shown a pinball machine playing compartment generally designated 12 which includes an inclined generally planar playing surface 14 having at the lower end thereof a ball return area 16 which is generally centrally disposed with respect to the edges thereof. In proximity to the ball return area 16, the pinball machine 12 is provided with a pair of "flippers" 18 and 20 which are generally operator controlled and solenoid actuated so that the pivoting thereof against a rolling ball 22 will redirect the ball 22 upwardly along the playing surface 14.

Adjacent the lower righthand edge of the playing surface 14 is a shooter mechanism 24 which is operator controlled to direct a ball 22 up a guideway 26 to the upper part of the playing surface 14 where the ball 22 operates down the incline under the force of gravity to pass through certain passageways 28 over switch means, or to be intercepted by various obstacles such as post-type ball bumpers 30 or to impact with slingshot-type ball bumpers 32 or 34.

The two slingshot bumpers 34 have the edges thereof angularly disposed in a downwardly converging manner to direct the ball toward the flipper members 18 and 20. Should the ball impact the edges in a non-parallel fashion, as will hereinafter be discussed, the slingshot bumpers 34 have resilient suspended bumper members which yield under the force of the impact.

Referring to FIGS. 2 and 3, a typical prior art slingshot mechanism with the decorative cover plate removed is illustrated, the mechanism typically including two or more post members 36 secured to a playing surface 38, each of the post members 36 having a peripheral groove formed therein for receiving and retaining a stretched elastic ring or band 40. In the embodiment illustrated in FIG. 2, the slingshot assembly has three post members defining a triangular configuration for elastic band 40, the band 40 being spaced generally parallel to the plane of the playing surface 38 at a height adapted to contact the approximate mid-point of a rolling metal ball 22 as illustrated in FIG. 3. Formed in the playing surface 38 within the triangle of elastic band 40 is an aperture 42 in spaced relation to the band 40, the aperture 42 having extending therethrough the movable leaf 44 of a leaf spring contact switch generally designated 46. As illustrated in FIG. 3, as the ball 22 impacts against the resilient elastic band 40, the movable contact member 44 is urged in the direction of the arrow to close the switch 46 to thereby actuate other electrical circuitry such as a solenoid or scoring means. As previously discussed, typically with a slingshot mechanism of the type shown in FIG. 2, the aperture 42 would normally contain a solenoid kicker arm with apertures formed in the playing surface 38 on either side thereof with each of the apertures containing the movable contact 44 of a similar type switch to switch 46, thereby requiring two leaf switches to actuate the kicker arm thereby increasing the number of components required for the machine, while simultaneously increasing the cost and complexity of the machine. The requirement for two leaf switches 46 when used in a slingshot mechanism in conjunction with a kicker arm is dictated by the fact that if the ball 22 contacts the band 40 near one of the post members 36, the inward deflection of the band 40 adjacent the other post 36 will not be as great as the deflection in proximity to the point of impact. Accordingly, if only one leaf switch were employed on one side of a kicker arm, should the ball 22 impact the band 40 on the other side of the kicker arm there is a likelihood that the switch 46 will not close. Thus, the need for two leaf switches 46.

In contrast to this, the ball bumper slingshot mechanism of the instant invention is illustrated in FIG. 4 in which a plurality of posts 48 (configured similarly to the outer configuration of the post members 36 in FIG. 2) are secured to the playing surface 14 generally perpendicular thereto, with at least one of the post members 48 being electrically conductive or having means for conducting electricity to a terminal strip 50 beneath the playing surface 14. Encircling the post members 48 is a resilient bumper member in the form of a rubber or elastic band 52 which is made of electrically conductive rubber, the band 52 being spaced generally parallel to the plane of the playing surface 14. An electrically conductive strip member 54 is embedded within the playing surface 14, or painted on with a conductive paint in spaced proximate relation to the length of band 52 which is in the path of travel of a ball 22 and of such a configuration that the impact of the ball 22 on the band 52 simultaneously touches both the conductive band 52 and the strip 54 to act as a switch closing. The strip 54 suitably provided with an electrical terminal 56 beneath the playing surface for electrical connection of other parts thereto.

Figure 5:
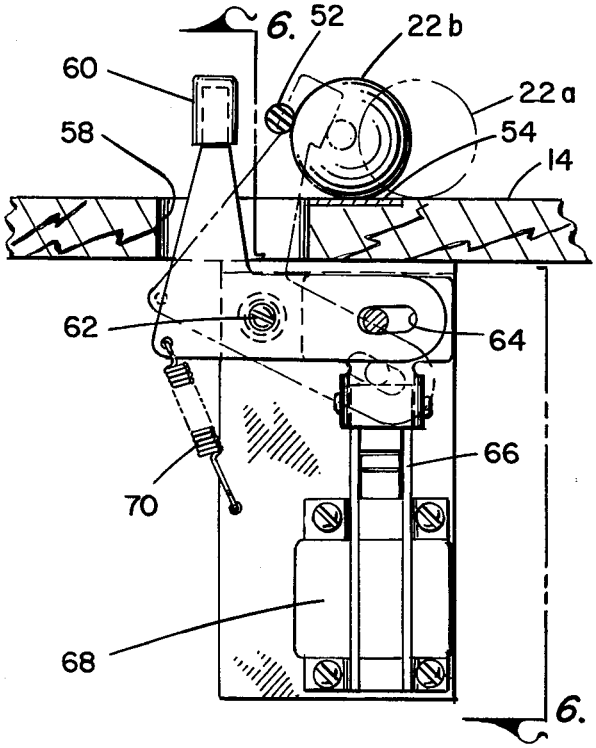
FIG. 5 is a cross-sectional view of the ball bumper assembly according to the invention taken generally along line 5—5 of FIG. 4.
Figure 6:
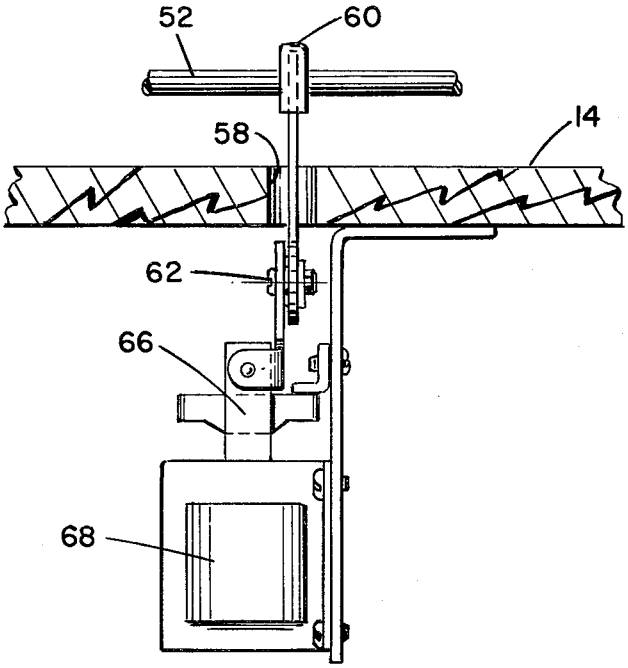
FIG. 6 is an end view of the solenoid actuated kicker arm as view generally along line 6—6 of FIG. 5.

The playing surface 14 is provided with an elongate slot 58 at the approximate mid-point of the length of band 52 in the path of travel of ball 22, the slot 58 having extending therethrough a kicker arm 60 which extends generally perpendicular to the plane of the playing surface 14 in proximity to and rearwardly of the band 52. As best illustrated in FIG. 5, the kicker arm 60 is a generally L-shaped member pivoted about an axis 62 adjacent the elbow thereof with the kicker arm 60 being of a height greater than the distance between band 52 and playing surface 14. The other arm is coupled by means of elongate slot 64 to the movable armature member 66 of a solenoid 68 mounted below the playing surface 14. The elbow of the kicker arm is coupled by means of a spring 70 to maintain the arm in its normal solid line position shown.

Viewing FIG. 5 as the ball moves from right to left from the position designated 22*a* to the position designated 22*b*, at position 22*b* the band 52 is contacted by the metal ball and simultaneously the metal ball is in electrical contact with the conductive strip 54 thereby completing a circuit to energize the solenoid 68. With energization of the solenoid 68, the armature 66 moves downwardly until the kicker arm 60 is in the dotted line position urging outwardly against band 52 to redirect the ball 22 outwardly in the direction from whence it came.

Figure 7:
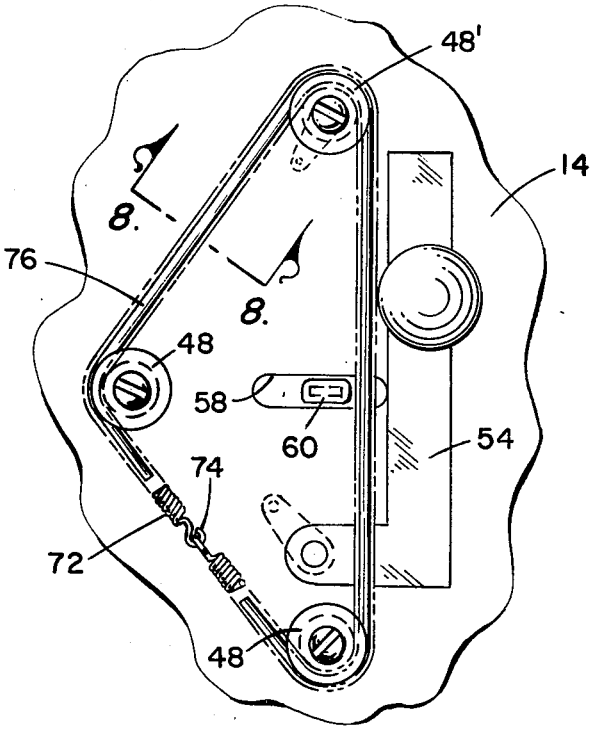
FIG. 7 is a top plan view of an alternate embodiment of the slingshot mechanism illustrated in FIG. 4.
Figure 8:
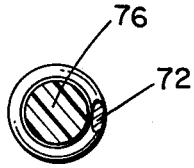
FIG. 8 is a cross-sectional view of the resilient bumper member taken along line 8—8 of FIG. 7.

In lieu of conductive rubber, as illustrated in FIGS. 7 and 8, a metal coil spring 72 may be utilized and suspended about the periphery of post 48 with one post 48' being made of a metal material to provide the electrical conduction required, the metal coil spring 72 having the end suitably coupled at 74 at a point outside the impact zone, that is, the zone adjacent conductive strip 54. If the coil spring 72, upon impact, vibrates excessively, the excessive vibration can be suitably dampened by insertion through the coil spring 72 of a soft plastic or rubber insert member 76 of rod-like configuration. The length of the insert 76 need only be sufficient to dampen the vibration and in the illustration of FIG. 7 the insert material 76 extends through the length of the impact zone and partially around the opposing post members 48 and 48'.

Figure 9:
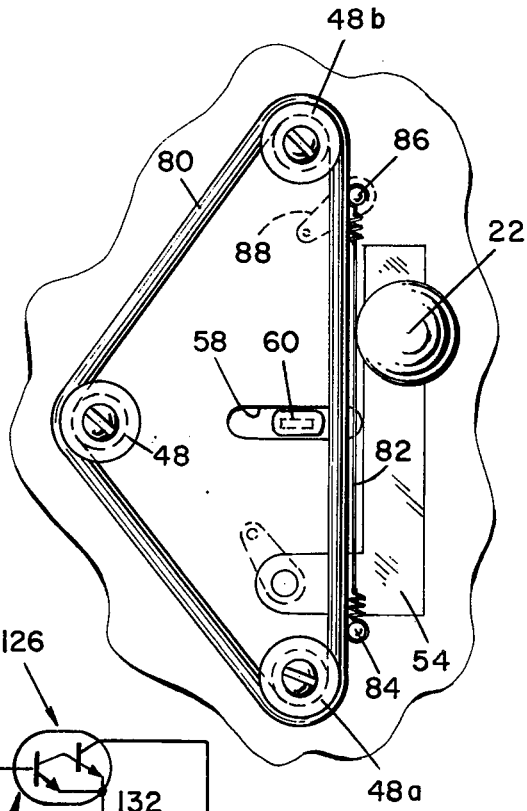
FIG. 9 is a top plan view of another embodiment of the slingshot ball bumper assembly of FIG. 4.

A third embodiment is illustrated in FIG. 9 wherein the post members 48, 48*a* and 48*b* have suspended thereabout an elastic band 80 of non-conductive rubber material with the length of band 80 between post members 48*a* and 48*b*, that is, the impact zone of the band 80, having secured to the surface thereof a wire element 82 suitably secured at opposite ends 84 and 86 to the impact length of the band 80. The securing ends 84 and 86 are spring loaded to permit deflection of the wire 82 as the band 80 yields under the impact of ball 22. One end 86 of the wire 82 is suitably electrically connected to a terminal 88 disposed beneath the playing surface.

Generally, with reference to all three embodiments illustrated in FIGS. 4, 7 and 9, the impact zone of the resilient bumper member is at least partially conductive to cooperate in conjunction with a conductive foil or strip on the playing surface having a length generally equal to the length of the impact zone, the conductive foil or strip being so-configured and so-positioned relative to the resilient bumper member to create a switch having a first stationary electrode and a deflectable, deformable or resilient second electrode, the electrodes being suitably bridged or closed by the metal ball 22 to actuate electrical circuitry to subsequently energize the solenoid 68 and the kicker arm 60.

Figure 10:
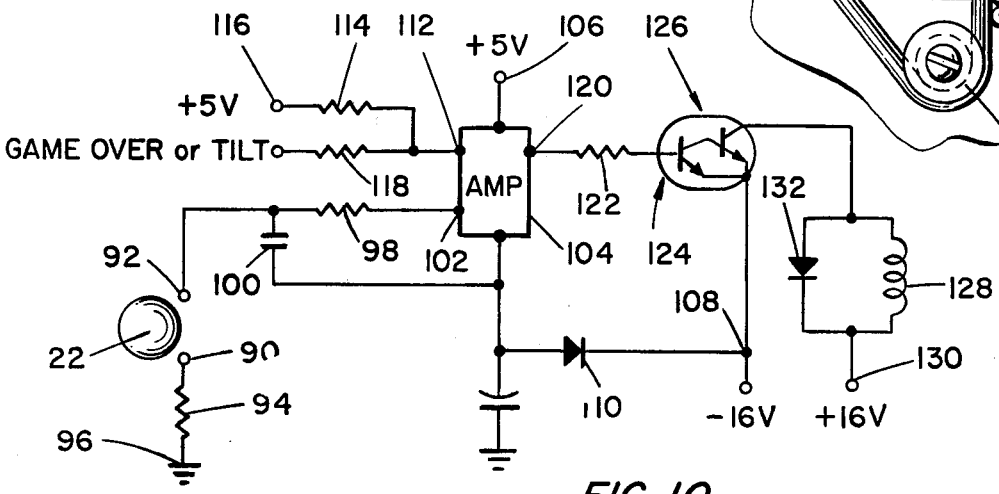
FIG. 10 is a schematic diagram of the electrical circuitry used to actuate the solenoid of the ball bumper assembly.

Electrically, this is accomplished by means of the circuitry shown in FIG. 10 in which the ball 22 is shown adjacent the two electrodes schematically illustrated and designated 90 and 92, the electrode 90 being coupled through a resistor 94 to ground 96. The other electrode 92 is electrically connected to one end of a resistor 98 and to one end of a capacitor 100. The other end of resistor 98 is coupled to a first input 102 of an operational amplifier 104 which is biased between a positive source of voltage 106 (+5 volts) and a negative source of voltage 108 (−16 volts) through a diode 110. The anode of diode 110 is connected to the other end of capacitor 100 while the cathode of diode 110 is connected to the negative voltage source 108.

The other input 112 of operational amplifier 104 is connected through a resistor 114 to a positive source of voltage 116 (+5 volts) and also connected through a second resistor 118 for receiving a signal indicative of a "tilt" or a "game over" signal, the occurrence of either of these signals inhibiting operation of the amplifier 104. The output terminal 120 of amplifier 104 is coupled through a resistor 122 to the base of the first transistor 124, the collector of which is coupled to the base of a second transistor 126 in cascade fashion with the emitters thereof coupled together and to the negative voltage source 108. The collector of transistor 126 is connected to the coil 128 of the solenoid 68, the other end of which is connected to a positive source of voltage 130 (+16 volts). Connected in parallel with the solenoid coil 128 is a discharge diode 132. The transistors 124 and 126 constitute a power amplifier to handle the current required for the approximate 32 volts driving the solenoid coil 128.

In operation, as the ball 22 simultaneously contacts electrodes 90 and 92, a circuit is momentarily completed from ground 96 through resistor 94 through ball 22 bridging the electrodes 90 and 92 to charge capacitor 100 through diode 110 to the negative voltage source 108 thereby charging capacitor 100 to +16 volts through resistor 94 which is approximately 47 ohms with capacitor 100 being 0.1 micro farads. This causes the output of amplifier 104 to switch to the high voltage state, that being the voltage of the positive voltage source 106 which is +5 volts. In the "off" condition, the amplifier 104 is at the negative voltage level of negative voltage source 108, that is, −16 volts. With the amplifier 104 in its "on" condition, the 5 volts is applied through resistor 122 which is approximately 2,000 ohms to the base of the two-stage power amplifier of transistors 124 and 126 to complete a circuit from the positive voltage source 130 through the solenoid coil 128 through the collector to emitter branch of transistor 126 to the negative voltage source 108 thereby applying 32 volts across solenoid 128. Notwithstanding the momentary contact of the ball 22 with the electrodes 90 and 92, the capacitor 100 immediately charges and discharges gradually in accordance with the value of resistor 98 which is 560 ohms to thereby provide a sufficient time delay to insure that the power transistors 124 and 126 remain conductive sufficiently long for the solenoid coil 128 to drive the armature 66 of solenoid 68 through a full stroke regardless of the time of contact of ball 22 with the electrodes 90 and 92. The amplifier 104 thereby acts as switch means operable in response to the charging of the capacitor 100 for a time period consistent with the discharging of capacitor 100, these switch means thereby rendering power transistor means conductive to energize the solenoid coil 128. Without this particular arrangement, if the ball 22 contacting the electrodes 90 and 92 were merely coupled directly to actuate the solenoid coil 128, the contact would be momentary and the solenoid power requirements would result in arcing between the ball and the electrodes 90 and 92. With the circuit of FIG. 10 the input stage is limited to 16 volts at low current levels with the output stage being controlled through 32 volts at higher current levels.

In summary, there has been shown and described a ball bumper assembly of the slingshot type wherein the resilient bumper member is at least partially conductive to act as one electrode of a switch to thereby eliminate the requirement for a pair of leaf switches in conjunction with a kicker arm. Additionally, the electrical circuitry is such that momentary bridging of the electrodes actuate switch means which remain energized for a predetermined time duration consistent with the time duration of energization required for the solenoid coil to effect a full stroke of the solenoid to actuate the kicker arm. While there has been shown and described a preferred embodiment, it is to be understood that various other adaptations and modifications may be made within the spirit and scope of the invention.

What is claimed is:

1. In a bumper mechanism for a ball rolling game utilizing a conductive metal ball or the like for rolling over a playing surface, the combination comprising:

a plurality of post members secured to the playing surface;

a resilient conductive member suspended by said post members in spaced generally parallel relation with said playing surface at a height for impacting by the ball, a suspended portion of said conductive member yielding upon impact of a ball traveling in a first direction;

a conductive area on said playing surface in spaced relation with and in proximity to said conductive member;

ball propelling means including a ball kicker arm in spaced relation with said conductive member on the side opposite the ball impacting side and a solenoid having an armature for actuating said ball kicker arm to redirect the ball upon impact of the kicker arm with said conductive member in a direction generally opposite to said first direction; and circuit means for energizing said solenoid, said circuit means including capacitor means charging in response to simultaneous contact of the ball with said conductive member and said conductive area and power amplifier means responsive to discharging of said capacitor means for energizing the coil of said solenoid to drive said armature through a full stroke regardless of the duration of contact of the ball with said conductive member and said conductive area.

2. The combination according to claim 1 wherein said capacitor means includes a capacitor in series circuit relation with a voltage source, said conductive area and said conductive member.

3. The combination according to claim 2 wherein said resilient conductive member is a conductive rubber band.

4. The combination according to claim 2 wherein said resilient conductive member is a coil spring.

5. The combination according to claim 4 wherein said coil spring includes dampening means.

6. The combination according to claim 5 wherein said dampening means includes an elastic member fitted within the inner diameter of said coil spring, the elastic member having a length at least equal to the portion of said coil spring in the path of travel of said ball.

7. The combination according to claim 2 wherein said resilient conductive member includes a rubber band having a conductive member secured to the surface thereof.

8. The combination according to claim 7 wherein said conductive member secured to the surface of said rubber band is a wire.

* * * * *